United States Patent [19]

Robertson et al.

[11] Patent Number: 4,852,769

[45] Date of Patent: Aug. 1, 1989

[54] REFRIGERANT CHARGING TOOL

[75] Inventors: James D. Robertson, Hollywood; Paul E. Balthaser, Hialeah, both of Fla.

[73] Assignee: Kwik Kool, Inc., Tallahassee, Fla.

[21] Appl. No.: 752,017

[22] Filed: Jul. 8, 1985

Related U.S. Application Data

[63] Continuation of Ser. No. 499,028, Jun. 2, 1983, abandoned, which is a continuation of Ser. No. 225,628, Jan. 16, 1981, abandoned.

[51] Int. Cl.[4] ..... B67B 7/24

[52] U.S. Cl. ..... 222/83.5; 222/89; 30/363; 30/448

[58] Field of Search ..... 222/5, 80–83, 222/83.5, 86–89; 137/317–318; 285/197, DIG. 22; 30/361, 363, 366–367, 443, 448

[56] References Cited

U.S. PATENT DOCUMENTS

| | | | |
|---|---|---|---|
| 2,008,807 | 7/1935 | Williams | 222/87 X |
| 3,147,887 | 9/1964 | Brooks | 222/83.5 |
| 3,303,968 | 2/1967 | Compere | 222/87 X |
| 3,370,752 | 2/1968 | Abler | 222/83.5 |
| 3,661,169 | 5/1972 | Mullins | 137/318 |
| 3,920,037 | 11/1975 | Hoff et al. | 137/318 |
| 4,112,944 | 9/1978 | Williams | 222/83 X |
| 4,128,918 | 12/1978 | Wenk | 285/DIG. 22 |
| 4,204,559 | 5/1980 | Walner | 222/83 X |
| 4,281,775 | 8/1981 | Turner | 222/83 X |
| 4,316,622 | 2/1982 | Nelson | 285/197 X |

*Primary Examiner*—Joseph J. Rolla

*Attorney, Agent, or Firm*—Herman J. Hohauser

[57] ABSTRACT

A refrigerant charging tool for use with conventional size freon cans, the tool being a hand-held implement adapted to nest about a can in a socket with extending lever arms normally spaced apart and adapted by squeezing to be biased toward one another to cause a piercing element to pierce the can and wherein the piercing element includes a valve to control flow from the can.

9 Claims, 1 Drawing Sheet

REFRIGERANT CHARGING TOOL

This application is a continuation of application Ser. No. 499,028, filed June 2, 1983 now abandoned, which is a continuation of Ser. No. 225,628 filed Jan. 16, 1981, now abandoned.

FIELD OF THE INVENTION

This invention relates to a refrigerant charging tool.

BACKGROUND OF THE INVENTION

In the past there have been numerous types of tools which have been proposed for use in removing freon from a can. This invention, generally, is of such a tool which is improved as is set forth more fully hereinafter and which is composed of a bifurcated socket defining member adapted to be nested about a can and wherein there are extending legs and a centrally located piercing element which includes a valve so that, when the legs are squeezed toward one another and a can is positioned in the socket, the piercing element will pierce the can to permit the freon to flow through the valve and piercing element to a tube connected to an automobile air conditioning system.

In the preferred embodiment, the device includes a one-way check valve so that in the event someone inadvertently attaches the hose to the high pressure side of the compressor, the pressure will be contained at the valve. It will not enter the can. Also, the valve is aimed away from the operator when the tool is being attached to the can. Preferably, the product is of a tough durable plastic which is impervious to cold or heat, such as that which is commercially available and known as Delrin, a product of the E. I. duPont Company. The check ball is preferably of stainless steel and the valve core is of brass and stainless steel, the valve barrel being of brass. The needle is hardened steel preferably with nickel plating so that it will not rust. The device is adapted for rapid charging of a system in relation to conventional can tap valves. In operation, to charge a system, a low pressure hose is connected to the fitting of the tool to depress the Schrader valve. A conventional size freon can, such as the often encountered 2⅝ inch diameter can is positioned as shown in the drawings within the tool. The tool is biased closed and it will puncture the can. When the manifold valve is opened, it does not have to be closed until the system is charged because of the check valve included in the device. This check valve prevents freon from leaking back through the tool. When the can is empty, the handles are opened and another can may be inserted and this process continued until the system is charged. Thereafter, the manifold valve is closed and a partially used can may be left in the charging line or unscrewed from the line. It will not leak the remaining portion of freon from the can.

OBJECTS OF THE INVENTION

It is an object of this invention to provide an improved hand-held implement for use in manipulating it so as to pierce a can of freon to remove the contents therefrom and to provide a tool of plastic material, preferably, which is available for opening freon cans and utilized in air conditioning systems of vehicles.

In accordance with this general object, the instant invention will now be described with reference to the accompanying drawings in which:

DESCRIPTION OF THE PREFERRED EMBODIMENT

Figure 1:
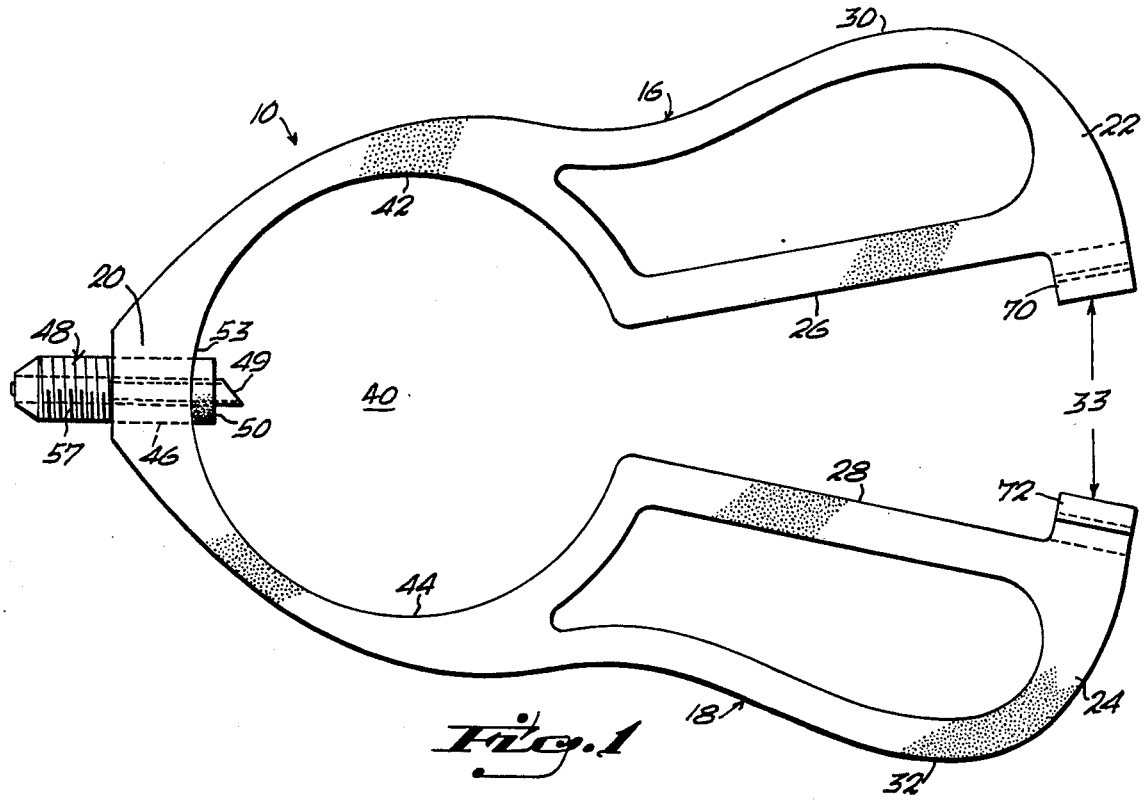
FIG. 1 is a plan view of a tool constructed in accordance with this invention and showing the same in a normal condition with the keeper means 70 and 72 out of engagement with one another.
Figure 2:
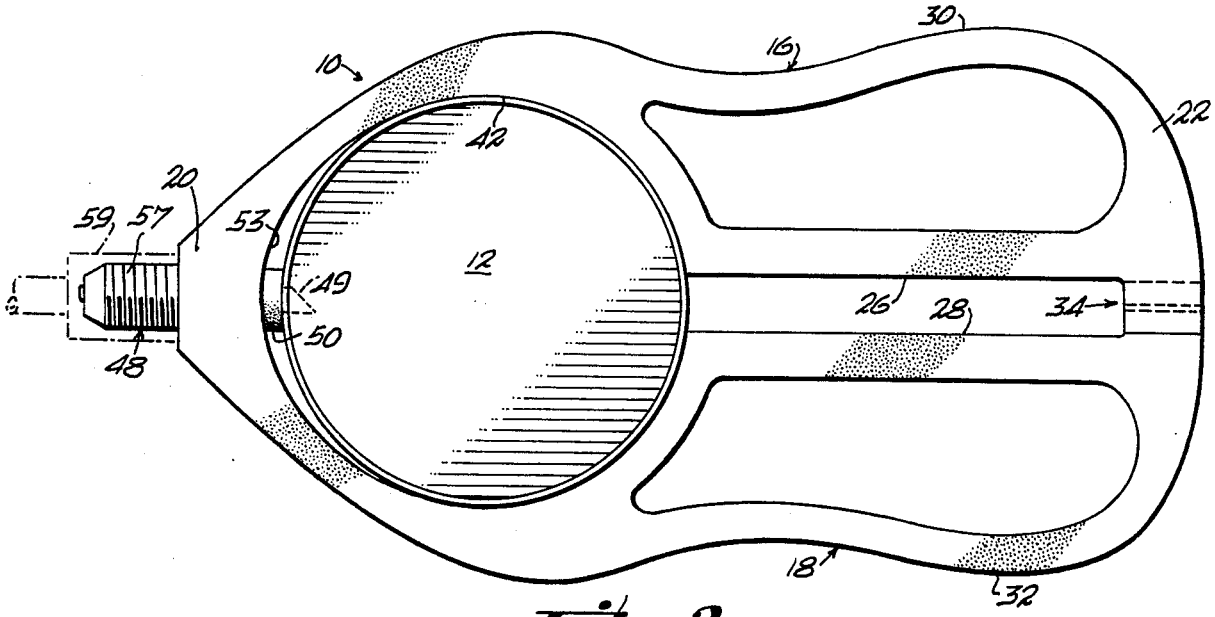
FIG. 2 is a view similar to FIG. 1 with a can of freon nested within the socket and in pierced engagement with the tool and with the legs in clamped engagement with one another.

Referring to the drawings wherein like reference characters designate like or corresponding parts throughout the several views, FIG. 1 generally designates a tool 10 which is adapted for piercing a can 12, see FIG. 2, which is of a conventional generally standard size and contains freon. The tool is used by a person such as garage mechanic to introduce the freon into the air conditioning system of a vehicle.

The cylindrical can is of a predetermined radius as is conventional.

The tool 10 comprises a bifurcated member defining a first and a second leg 16 and 18. Each of said legs has a first end integrally connected together defining a nose 20 of the tool and extend to terminal ends 22 and 24. Each of these legs has an inside surface, such as 26 and 28, which are normally in confronting relation to one another as well as outside surfaces 320 and 32. The terminal ends are normally in spaced relation from one another as indicated by the arrowed line 33 and, as shown in centerline perpendicular to the first end and, further, the legs are preferably mirror images of one another with the exception of the locking zone generally designated by the numeral 34 in FIG. 2, and which will be described more fully hereinafter. Each of the legs includes a portion adjacent the nose, that is the first end, which are generally semi-circular as seen in plan and comprise a clamping zone 40, the first portions of semicircular form being designated by the numerals 42 and 44.

A hole 46 is provided in the nose of the tool and it is sized and configured to receive and securely hold a valve means which is normally closed and this valve includes a piercing sleeve 49 which extends from it. As seen in FIGS. 1 and 2, about this piercing sleeve a sealing gasket 50, of rubbery material or neoprene, is provided with the same being in abutting engagement with the inside surface 53 of the nose. This sleeve is in fluid communication with the valve which, as is conventional, is adapted to be connected by exterior threads 57 to a fitting indicated by the dotted line 59. A conventional Schrader valve core 48 such as described in U.S. Pat. No. 4,204,559 as an air core type of valve commonly sold under the trademark Schrader and known as one provided with a spring biased axial stem and used in automobile and bicycle tires and is utilized for this purpose so that the valve pin is depressed by the fitting 59. As shown, the clamping zone is sized to nest about a can positioned in the zone, as shown in FIG. 2, and to this end, the leg portions are of a radius of curvature slightly greater than that of the radius of the conventional freon can. The legs, shown in FIG. 1 which are normally spaced apart are yieldable by reason of the fact that the bifurcated member is of rigid yet bendable plastic, such as nylon, polypropelene or the like with a memory to cause it to normally be in the open position shown in FIG. 1, and adapted to receive a can within the zone and wherein when pressure is applied to the legs, the same are adapted to be brought into abutting engagement with one another and, in so doing, urge the can 12 into piercing engagement with the terminal end of the sleeve, so that, when a fitting is connected to its as shown in FIG. 2, the freon will escape through the tube 61 to a desired location.

Figure 3:
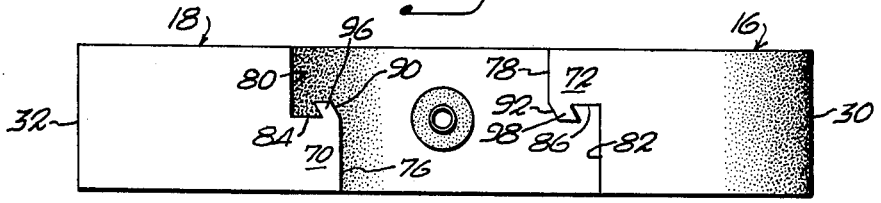
FIG. 3 is a right side view of the tool shown in FIG. 1.

The terminal ends of the legs may be provided in the preferred embodiment with the keeper or lock means 34, to lock the legs in the position shown in FIG. 2, that is, in piercing engagement with a can. To this end, the terminal ends include projecting portions 70 and 72. Each of these projections is adapted for hooked-up relation with one another and, as shown in FIG. 3, each of the projections 70 and 72, includes an outer surface 76 and 78 and a recessed surface 80 and 82 joined by a shoulder 84 and 86 which has an outer facing surface 90 and 92 to guide the barb on each 96 and 98 into hooked-up engagement one with the other, that is, into the position as shown in FIG. 3.

What is claimed is:

1. A hand-held can piercing tool comprising:

a nose portion;

first and second handle means extending from said nose portion, can piercing means located in said nose portion, and first push means located on said first handle means and second push means located on said second handle means wherein said first and second push means are equal distanced from said nose portion and forces a can positioned between said first second handle means into engagement with said piercing means upon the user grasping and squeezing said first and second handle means with one hand.

2. The can piercing tool of claim 1 wherein said first and second handle means are generally symetrically positioned with respect to said nose portion.

3. The can piecing tool of claim 2 wherein said nose portion, said first and second handle means and said first and second push means are formed from a one-piece member.

4. The can piercing tool of claim 1 wherein said nose portion, said first and second handle means and said first and second push means are formed from a one-piece member.

5. The can piercing tool of claim 1 wherein said first and second handle means are naturally biased in an open position to allow insertion of a can therebetween.

6. The can piercing tool of claim 4 wherein said first and second handle means are naturally biased in an open position to allow insertion of a can therebetween.

7. The can piercing tool of claim 6 wherein lock means are provided on said first and second handle means for maintaining said piercing means in engagement with a can.

8. The can piercing tool of claim 7 wherein said lock means consists of a single projection on said first handle means and a single projection on said second handle means that become interlocked with each other in the locked position.

9. The can piercing tool of claim 8, wherein each of said single projections of said first and second handle means includes an outer surface and a recessed surface joined by a shoulder said shoulder having an outer facing surface forming a barb wherein in a locking position each of said barbs mates with the other.

* * * * *